United States Patent [19]

Sherbondy

[11] Patent Number: 4,610,373

[45] Date of Patent: Sep. 9, 1986

[54] BALL DISPENSER

[75] Inventor: William A. Sherbondy, Cleveland, Ohio

[73] Assignee: Jalimar Industries Inc., Cleveland Heights, Ohio

[21] Appl. No.: 790,757

[22] Filed: Oct. 22, 1985

Related U.S. Application Data

[63] Continuation of Ser. No. 677,043, Nov. 30, 1984, abandoned.

[51] Int. Cl.[4] ..... B60R 9/08

[52] U.S. Cl. ..... 221/155; 221/185; 221/227; 221/303

[58] Field of Search ..... 221/279, 227, 303, 185, 221/155, 283, 309, 226, 243, 262; 211/14–15; 312/49, 71; 273/32 D, 201, 74; 224/274, 919; 206/315.9

[56] References Cited

U.S. PATENT DOCUMENTS

| | | | |
|---|---|---|---|
| D. 83,254 | 2/1931 | Holm . | |
| 107,442 | 9/1870 | Buckman . | |
| 780,329 | 1/1905 | von Dutczynski . | |
| 1,485,716 | 3/1924 | Rogers . | |
| 1,810,491 | 6/1931 | McClure . | |
| 1,940,321 | 12/1933 | Pagett . | |
| 2,221,704 | 11/1940 | Farley | 312/49 |
| 2,516,997 | 8/1950 | Kellinger et al. . | |
| 2,528,723 | 11/1950 | Hane . | |
| 2,570,504 | 10/1951 | Van House . | |
| 2,580,734 | 1/1952 | Criner . | |
| 2,713,338 | 7/1955 | Abagoff . | |
| 2,756,914 | 7/1956 | Bonderer . | |
| 2,780,508 | 2/1957 | Bonderer . | |
| 2,800,890 | 7/1957 | Starek . | |
| 2,950,748 | 8/1960 | Olinghouse . | |
| 2,962,321 | 11/1960 | Fowler . | |
| 2,966,280 | 12/1960 | Nelson | 273/74 X |
| 3,087,481 | 4/1963 | Foster . | |
| 3,117,814 | 1/1964 | Webb . | |
| 3,233,727 | 2/1966 | Wilson | 206/315.9 X |
| 3,236,521 | 2/1966 | Knott . | |
| 3,412,897 | 11/1968 | Slater | 221/309 X |
| 4,042,156 | 8/1977 | Knight | 221/309 X |
| 4,082,209 | 4/1978 | Sanders | 221/309 X |

FOREIGN PATENT DOCUMENTS

| | | | |
|---|---|---|---|
| 41072 | 10/1932 | France | 221/227 |

*Primary Examiner*—Charles A. Marmor

[57] ABSTRACT

A golf ball dispenser is shown. It comprises a tube into which a stack of golf balls can be loaded, a base at the bottom of the tube, a cap at the top of the tube, a resilient coil spring disposed for urging balls of the stack upwardly in the tube, a ball-accepting and dispensing side aperture near the top of the tube for retaining balls that are out of register with that aperture, and, in the cap, a finger access or a plunger for manually depressing the topmost ball of the stack into dispensing register with the side aperture. The side aperture includes a finger notch which extends downwardly toward the base of the dispenser a distance sufficient for exposing part of the exterior surface of the first two balls stacked under the topmost ball.

3 Claims, 7 Drawing Figures

BALL DISPENSER

This is a continuation of application Ser. No. 677,043 filed on Nov. 30, 1984, now abandoned.

This invention relates to a dispenser for balls, especially sports balls.

Heretofore many ball dispensers that were proposed depended on a gravity feeding of the balls or simply had balls statically disposed one above the other slightly apart from one another in a tubular holder for plucking therefrom. Few spring-loaded dispensers have been featured. Notably there is one for small pellets; it served as the handle element of a slingshot. In such dispensing the user plucked comparatively small spherical pellet ammunition one-by-one essentially upwardly from the top of the dispenser against a liftable spring that at rest blocked a top aperture.

Advantages of the instant invention over various prior proposals include compactness, facility of one-hand operation when used for medium-sized balls such as golf balls, simplicity of structure and construction, and nothing necessarily to open, unlatch, unfasten, undo, detach, unhook, unclasp, unbutton, spring open, unpin, unstrap, unlace, or unbuckle.

BROAD STATEMENT OF THE INVENTION

This invention has two aspects, one a unique ball dispenser of tubular configuration and the other the upper portion of such dispenser as a dependent and related subcombination. The instant ball dispenser comprises a tube into which a stack of golf balls can be loaded, a base at the bottom of said tube, a cap at the top of said tube, resilient means disposed for urging balls of the stack upwardly in said tube, a ball-accepting and dispensing side aperture near the top of said tube, said aperture being disposed for retaining in said tube the balls that are out of dispensing register with said aperture, and means for manually depressing the topmost ball of the stack into dispensing register with said aperture. The subcombination top portion is the upper part of the tube with said cap and side aperture for accepting and dispensing balls, said top portion being fastenable onto a bottom tubular section that is adapted to feed balls upwardly into it.

DESCRIPTION OF THE DRAWINGS

FIGS. 1, 4, and 7 are broken to foreshorten their lengths.

Figure 1:
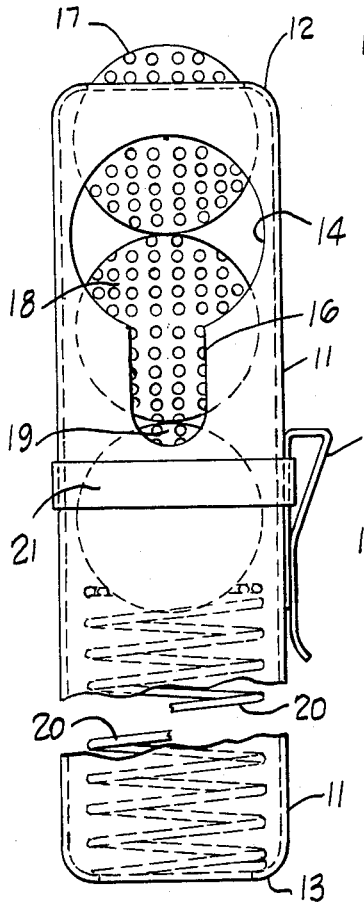
FIG. 1 shows a preferred embodiment of a golf ball dispenser in vertical elevation.

Looking particularly now at FIG. 1, aluminum tube or ball magazine 11, about $1\frac{7}{8}$ inches I.D., has open top cap 12 and open base 13; said cap and base are formed in unitary manner with tube 11 by rolling the ends of the tube. The top of ball-accepting and dispensing aperture 14 is displaced 9/16 inch down from the topmost elevation of the cap. Top golf ball 17 protrudes part way up through cap 12. It is retained by the opening in the cap, such opening being slightly smaller (1 9/16 inch) in the diameter than that of a standard golf ball (about $1\frac{5}{8}$ inch). Aperture (ball hole) 14 has extending down from it a finger notch 16. This is useful to arrest balls of the stack from rising any farther than the bottom of the notch when one places finger in the notch (e.g., to facilitate loading balls through aperture 14). The aluminum is 15 gauge (AWG).

The second highest golf ball in the stack loaded in tube 11 is depicted by item 18. The very top of a third golf ball is visible through the finger notch, and it is depicted by item 19. Item 21 is a clamping ring fitted tightly around tube 11 to hold spring clip 22 in place. Clip 22 is used to attach the carrier to the top of a golf bag for hanging it inside or outside thereof. All raw metal edges of this dispenser are deburred, smoothed and polished to protect the user. They can be covered, if desired, with a protective film such as tape or rubbery coating.

Any balls below ball 19 would be invisible, and none are contemplated in this view. When fully loaded, this very dispenser contains six balls; it is $15\frac{3}{4}$ inches long overall. Also practically obscured in this view is a resilient coil spring 20 having its bottom seated on the inside of base 13 in tube 11 and extending upwardly in the tube so that its helical coil is close to the interior wall of the tube and reaches up to exert gentle upward pressure directly on the bottom ball (19) of the stack in tube 11, thus on the whole stack or column of balls.

To release ball 17 for use one pushes that ball downwardly with a finger into dispensing register with aperture 14 and impels it through that aperture. This can be done one-handedly or two-handedly.

To reload the same now-dispensed ball 17 back into tube 11 one can depress the ball 18 (which is now the top ball) downwardly with a finger reaching through the top hole (in cap 12) then continue this downward ball movement with yet another finger reaching through aperture 14 and finally clear down so that said another finger rests in and reaches through finger notch 16 and holds ball 18 below that said another finger. Then one simply puts ball 17 through aperture 14, pulls out said another finger from finger notch 16, and lets pressure from spring 20 lift ball 17 to its original uppermost position. In the manufacture of this version of the dispenser spring 20 is inserted into tube 11 before the upper end is rolled to form unitary cap 12.

Figure 2:
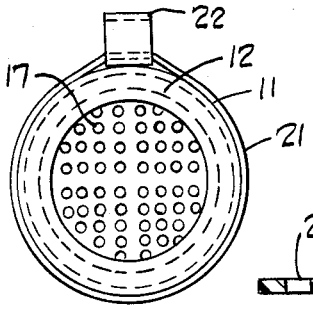
FIG. 2 is a top view of the same dispenser.

Attention now is drawn to FIG. 2, a top view of the dispenser of FIG. 1. Item 17 is the upper part of the golf ball protruding through open top cap 12. The cap is unitary with tube 11 (which extends downwardly from the cap). Surrounding the wall of tube 11 is clamping ring 21 that attaches spring clip 22 firmly to the dispenser.

Figure 3:
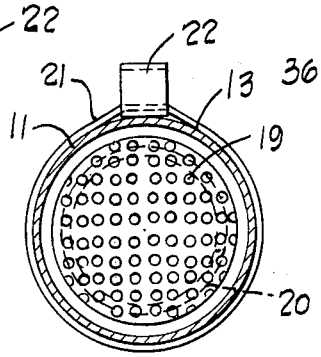
FIG. 3 a bottom view of the same dispenser.

Turn now to FIG. 3, a bottom view of the dispenser of FIG. 1. Open base 13 is unitary with tube 11 and is perforate by virtue of the central hole therein. The coil spring (item 20) that urges the balls upwardly is somewhat obscured by said base. It exerts pressure directly on the bottom ball (ball 19) of the stack of three, some surface of which ball 19 can be seen through the hole in base 13.

Figure 4:
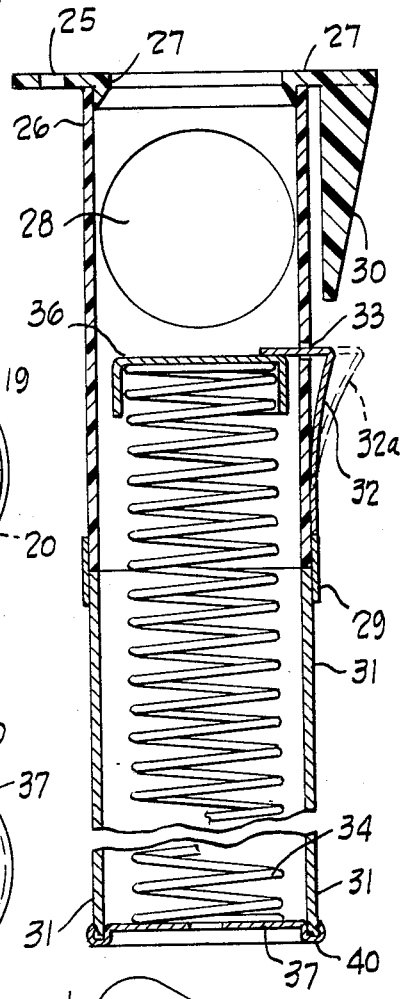
FIG. 4 shows another desirable form of the dispenser, this time in cross-sectional elevation.

FIG. 4 shows an empty composite dispenser for golf balls in cross-sectional elevation. The top part (i.e., tube 26 and open top cap 27) is of transparent rigid plastic such as polymethylmethacrylate. Cap 27 shown here is cemented to tube 26 (of about the same I.D. as the tube in FIG. 1). Projecting downwardly from and attached to cap 27 is clip 30 of a tough plastic for hooking the dispenser onto the top of a golf bag. The hole in cap 27 permits downward finger pressure to push the top ball, thence the stack, array or column of balls, downwardly. It is too small to let a golf ball through. Ballhole 28 in the wall of tube 26 is large enough to permit a golf ball into and out of the tube when the ball is in register with the hole ("dispensing register" for going out, "admitting register" for entering).

Through small hole 33 in the wall of tube 26 there projects stack-arrester or holdback 32; this item is shown in depressed operating position in full line and in dotted line as item 32*a* when in a retracted, normal position. In this case item 32 is a small leaf spring that is adhesively united at its bottom to the outside wall of tube 26. The holdback could, of course, be a pin, shaft, or blade that is manually moveable (depressable) to engage item 36 or a ball above it and stop the upward movement thereof; and it could be spring-loaded to retract automatically when manual pressure is released (and thereby free item 36 and the ball of restraint). Item 36 is a cup-like cover over the top of coil spring 34.

The function of the stack-arresting means is like that of the finger that one thrusts through finger notch 16 of FIG. 1 to facilitate ball loading through hole (aperture) 28. Accordingly, "stack-arresting means" in this specification can be considered to be a manually-operated means like item 32 of FIG. 4, a fingerhole like item 16 of FIG. 1, or an equivalently-acting pin, shaft or blade.

The bottom of this composite dispenser is lacquered, opaque fiberboard tube 31. It extends downwardly from a butt joint with clear plastic tube 26.

The plastic and fiberboard tube sections are united by collar 29 which is cemented to the outer tube walls. This connection can be replaced by forming with or attaching flanges to the tube ends where they join and connecting such flanges with cement or fasteners such as screws or bolts; alternatively the end of one tube, typically the top of the lower fiberboard one, can be screwed into the bottom of the upper plastic one. In such instance the threads can be disposed to give essentially the same I.D. in both tubes, but often it is less expensive to thread the outside of the lower tube into inside of the upper, with the upper one being very slightly larger in I.D. than is the lower one. Threads for the fiberboard desirably are on a metal collar that is attached tightly to the top of fiberboard tube section 31. Tubes can be lined to reduce or eliminate changes in interior dimension, impart smoothness, toughness, impact resistance, etc.

A screwed joint for this dispenser can have customary continuous single complementing threads, or it can have interrupted complementing threads like a breech lock threading for quick attachment and detachment, or it can have a multiple (e.g., triplex) parallel complementing threads like some fountain pen caps and barrels, also for quick connection and detachment. Such reconnectable detachment allows balls to be loaded directly into the upper and lower tube sections, rather than through the dispensing aperture.

Resilient coil spring 34 extends upwardly from metal base 37 to spring top cover 36 in transparent tube section 26. Base 37 is tightly crimped onto the bottom of fiberboard tube 31 to form annular bead 40. Further upward travel of the spring and cover is arrested by the top of leaf spring 32 which is shown pushed through hole 33 into a detaining relationship with spring cover 36. When balls are stacked inside, cover 36 and spring 34 normally exert upward pressure on the stack of balls.

A special feature of a two-component or composite tube is a single top that can fit onto and complete a variety of bottoms (or vice-versa). Accordingly, a particularly valuable inventive subcombination here, and one that is dependent upon and related to instant ball dispenser in full combination, is the upper subcombination such as the one shown in FIG. 4. It embodies the upper part of the tube, the cap, the side aperture for dispensing balls (and, if desired, also loading them in), stack-arresting means if desired (a finger slot at bottom of loading/unloading aperture, or a pin, shaft or blade that is moveable to stop a ball from rising under spring pressure), and a hole in the cap or other means accommodating manually-powered depression of the topmost ball of a stack load into dispensing register with the unloading aperture. Advantageously, such subcombination has a transparent portion or a plurality of them (e.g., holes or clear plastic portions) all the way up, or it is almost totally transparent to gauge visually the uppermost balls available inside the tube. The various tube bottoms made to fit such top; e.g., an aluminum or fiberboard bottom, can be customized if desired to different lengths (capacities) and made each with a special ornamental design or indicia or distinctive coloration (e.g., spray painted, stencilled, special decalcomania applied, or other decoration). Clearly the bottom subcombination of tube bottom, base and coil spring or other resilient means is a necessary adjunct to such subcombination top portion to render it of special utility. However, as such upper subcombination can be used with a plurality of bottom subcombinations, the top subcombination is not to be considered conventional in assembly or individually.

Figure 5:
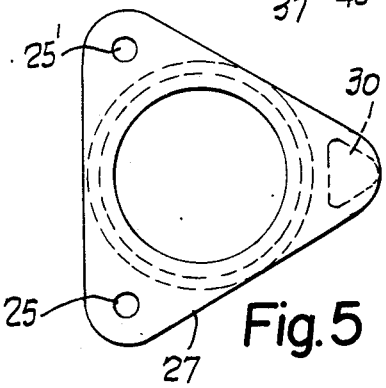
FIG. 5 shows the dispenser of FIG. 4 in top view.

FIG. 5 is a top view of the dispenser of FIG. 4. Items 25 and 25' are holes in cap 27 in which one can removably plug golf tees for handy access to these golf ball assistants. Cap 27 is generally triangular and clip (hook) 30 projects downwardly from one corner of the triangle. The cap can, of course, be made in various other shapes for use in the field and in packaging.

Figure 6:
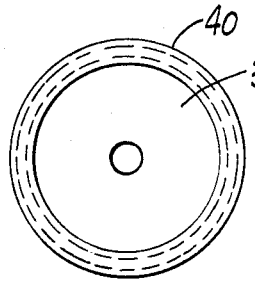
FIG. 6 in bottom view.

FIG. 6 is a bottom view of the dispenser of FIG. 4 wherein base 37 is on tin-plated steel crimped all around tightly onto the bottom of fiberboard tube 31 to make an annular bead 40. There is a hole substantially in the center of base 37 for allowing drainage and fallout of debris.

Figure 7:
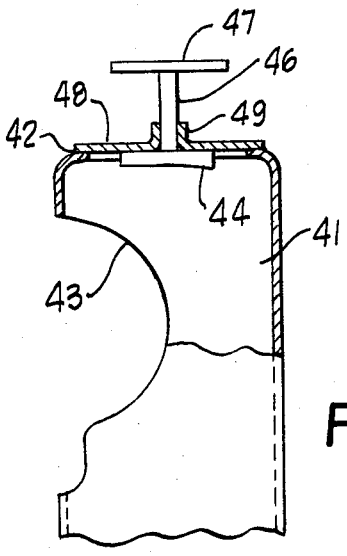
FIG. 7 shows a cross-sectional elevation of the top elements of still another embodiment of the dispenser.

FIG. 7 is the side elevation view of a cutaway upper section of a ball dispenser unit made of aluminum. Tube 41 has in one piece with it an open cap 42, the opening of which is covered over by disc-like fitment 48. Fitment 48 has arising from it and unitary with it plunger guide 49 of square cross section. Fitment 48 is attached to cover 42 by cement. Plunger 46 of square cross section passes snugly through guide 49. To the top of plunger 46 is a button for applying finger pressure downwardly. This pressure is transmitted by plunger 46 to base 44. Base 44 is slightly biased to urge the top ball of a stack not only downwardly into diepensing register with ballhole 43, but also outwardly through said hole. The rigid fitment 48 (and plunger 46) could be replaced by an elastic diaphragm. Ballhole 43 has a fingerslot at its base for serving as stack arresting means.

A resilient coil spring (advantageously of galvanized steel, but also feasible when made of other metal or plastic-coated steel or even coiled solid plastic) is the preferred resilient means for urging balls of a stack upwardly in the tube here.

The tubes, bases, caps, and other fittings of this device can be made of metal, plastic, fiberboard (or paperboard) in various combinations to take advantage of the customary engineering properties and adaptations of these materials. Fastenings advantageously can be made by adhesives such as thermosetting or thermoplastic adhesives, screw threaded joints, mechanical fasteners such as bolts or screws, mechanical crimping, and other conventional ways generally suitable for such connection. While it often is cheaper to make the base and cap unitary with the tube, a cap or base that screws on or is secured on to the base or tap of the tube, e.g., with a breech lock or related interrupted thread fastening or like twistable connection, makes an excellent article that can be disassembled, cleaned, and loaded with ease. The tubes and portions thereof preferably are substantially cylindrical, but can be prismatic, i.e., polygonal in cross section such as a regular hexagon or octagon. Conventional clips, clamps and snap fittings are useful for attaching the dispenser to a golf bag, a belt, a stand or the like, but other conventional attachments also are possible, e.g., a "Velcro" TM fastener, bolts and nuts, hooks and eyes, gudgeon and pintle, cords or chains, etc., or the dispenser can be carried in a pouch, sleeve or long pocket, e.g., one running down the side of and fixed to a container such as a golf bag or suspended therefrom as by a cord or chain.

Clearly this invention is capable of many modifications without changing its nature and scope or departing from the essence and spirit of the invention, and it should be limited only by the appended claims.

I claim:

1. A golf ball dispenser comprising a tube into which a stack of golf balls can be loaded, a base at the bottom of said tube, a cap at the top of said tube, a resilient coil spring disposed for urging balls of the stack upwardly in said tube, a ball-accepting and dispensing side aperture near the top of said tube, said aperture being substantially nondeformable and disposed for retaining in said tube the balls that are out of register with said aperture, said aperture being substantially out of dispensing register with the two topmost balls of said stack when said dispenser is loaded and said stack is at rest, the top of said aperture being substantially below the top of said tube, the sides of said aperture being rounded, the direct projection of said aperture being broadly similar to and slightly larger than that of a golf ball which is to pass therethrough, said aperture having a finger notch that extends therefrom towards said base a distance sufficient for exposing part of the exterior surface of the first two balls stacked under the topmost ball, and an access means in said cap for manually depressing the topmost ball of the stack into dispensing register with said aperture.

2. The dispenser of claim 1 wherein said access means is a finger access for depressing the topmost ball.

3. The dispenser of claim 1 wherein said access means is a plunger for depressing the topmost ball.

* * * * *